United States Patent [19]

Dola et al.

[11] 3,985,416

[45] Oct. 12, 1976

[54] OPPOSED EDGE SLOTTED TERMINAL ELECTRICAL CONNECTOR

[75] Inventors: Frank Peter Dola, Port Richey; Frederick William Rossler, Jr., New Port Richey, both of Fla.

[73] Assignee: AMP Incorporated, Harrisburg, Pa.

[22] Filed: Mar. 5, 1975

[21] Appl. No.: 555,484

[52] U.S. Cl. ..... 339/98; 174/88 R

[51] Int. Cl.[2] ..... H01R 11/20

[58] Field of Search ..... 339/97–99; 174/88 R

[56] References Cited

UNITED STATES PATENTS

| | | | |
|---|---|---|---|
| 3,012,219 | 12/1961 | Levin et al. | 339/98 |
| 3,189,863 | 6/1965 | Leach | 339/99 R |
| 3,631,378 | 12/1971 | Ellis, Jr. | 339/125 R |
| 3,865,460 | 2/1975 | Cherney et al. | 339/98 |

FOREIGN PATENTS OR APPLICATIONS

| | | | |
|---|---|---|---|
| 67,298 | 2/1951 | Netherlands | 339/97 R |

*Primary Examiner*—Roy Lake
*Assistant Examiner*—Neil Abrams
*Attorney, Agent, or Firm*—R. W. Pitts; F. W. Raring; Jay L. Seitchik

[57] ABSTRACT

An electrical connector for commoning a plurality of conductors, such as insulated wires, employs two similar mating insulating housings and a terminal plate formed from a resilient conductive metal. Conductor contact means such as parallel edge slots extend inwardly from two opposed edges of the terminal plate. The terminal plate is mounted in recesses formed in the housings and wire supporting passages traverse the recesses so that the electrical connection can be established between the various conductors and the terminal plate.

8 Claims, 10 Drawing Figures

FIG 3
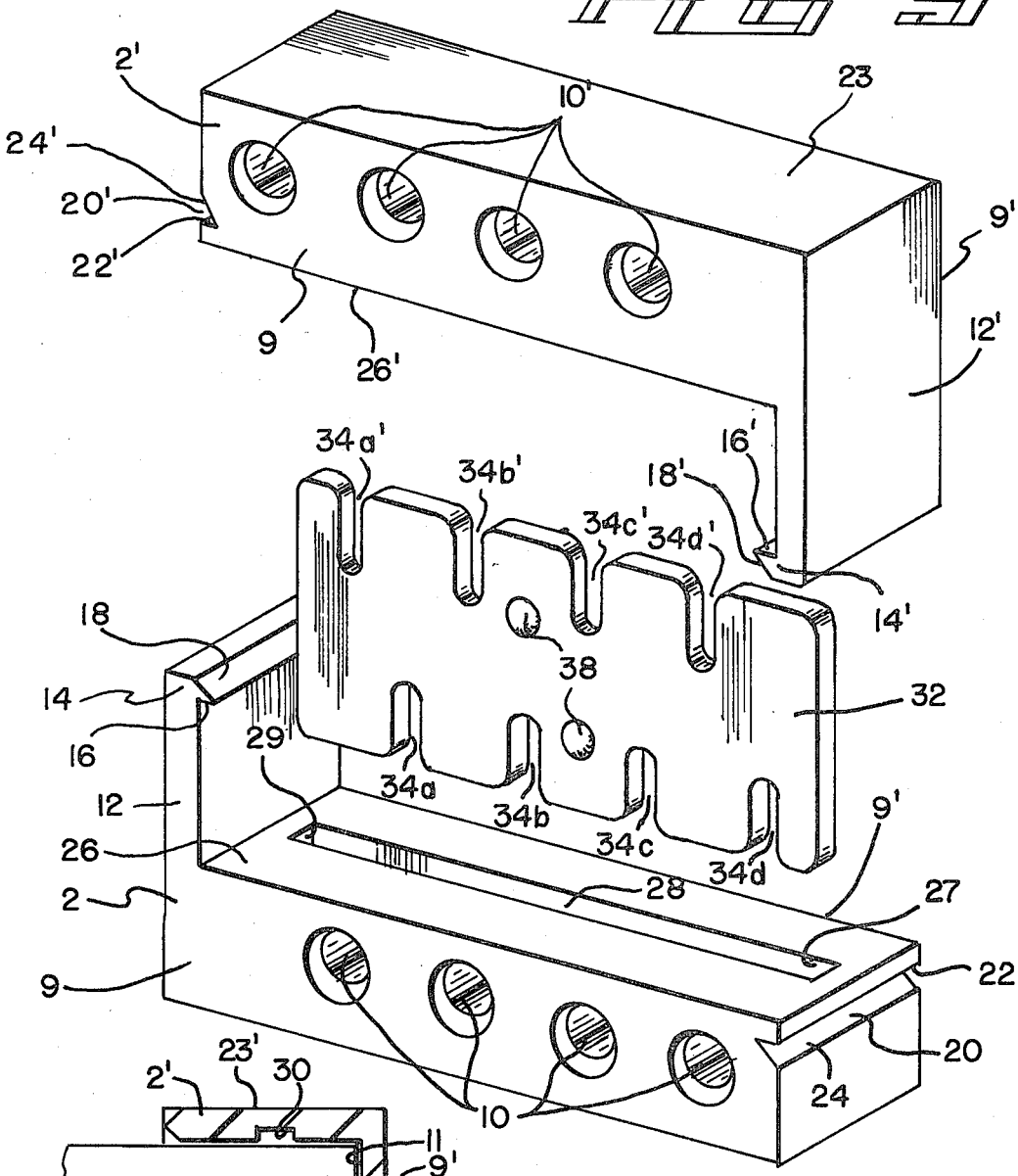
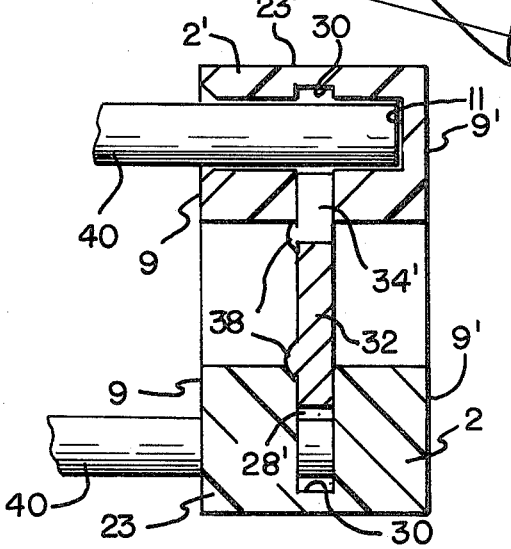
FIG 4
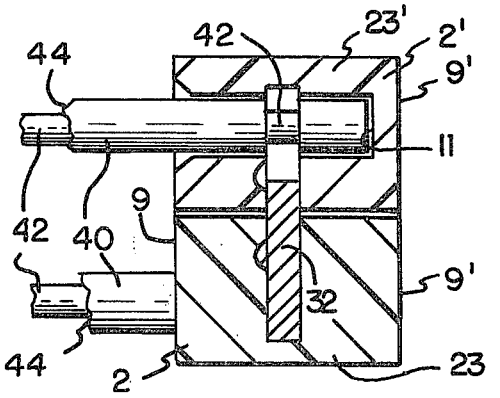
FIG 5

FIG 6
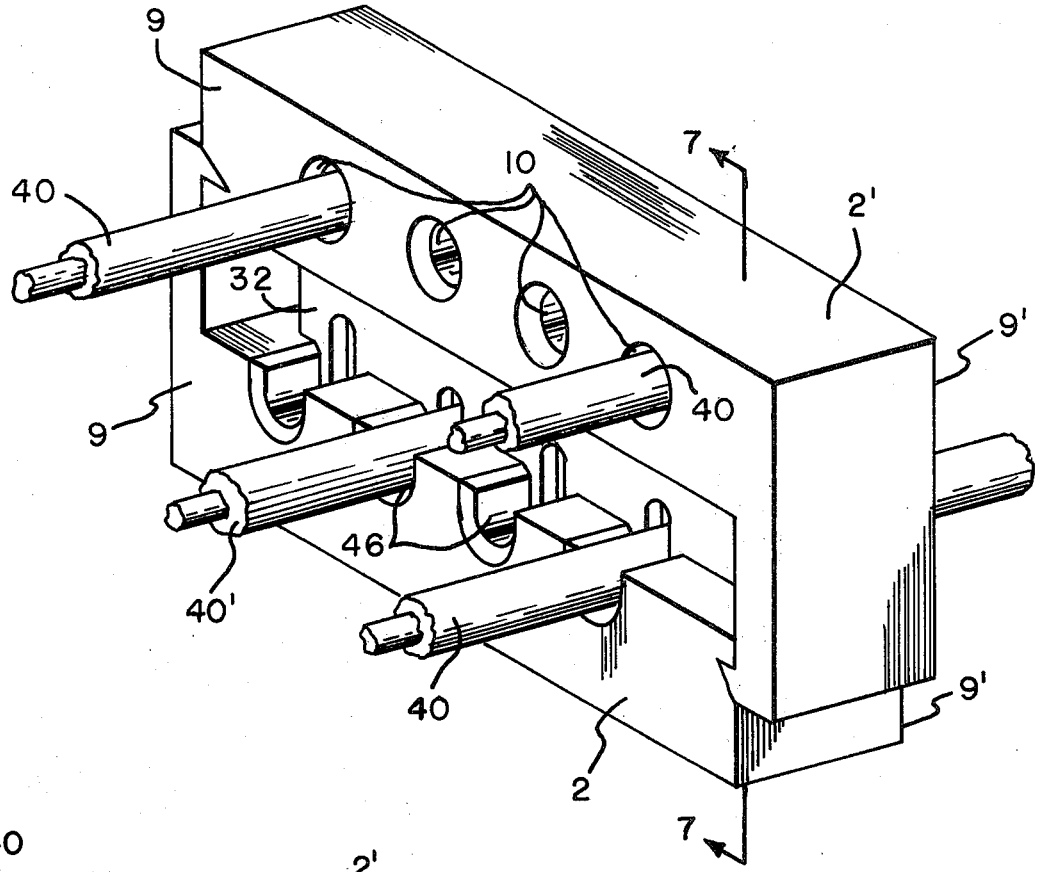
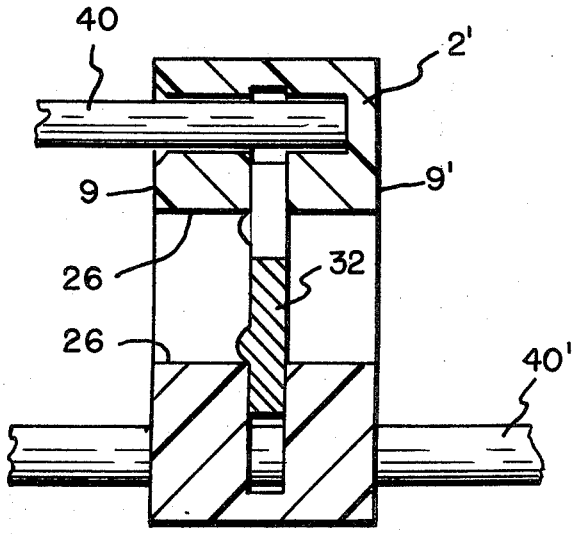
FIG 7

OPPOSED EDGE SLOTTED TERMINAL ELECTRICAL CONNECTOR

BACKGROUND OF THE INVENTION

1. Field of the Invention

This invention relates to an electrical connector having an insulating housing and a conductive terminal portion mounted therein. This connector permits the electrical interconnection of a plurality of insulated connectors. This connector is especially useful with round insulated wires since an insulation piercing or displacing wire-receiving portion may be utilized.

2. Description of the Prior Art

There are numerous devices which utilize slotted terminal plates for splicing a plurality of wires. Perhaps the most pertinent in relation to the instant invention is the device disclosed in U.S. Pat. No. 3,012,219. The device disclosed in this patent is particularly adapted to splicing small insulated wires such as those used in telephone circuits. Like the instant invention, that device utilizes a slotted plate which is inserted into an appropriate housing recess. Since that device is particularly adapted for use with small wires, the plate-recess geometry there is especially critical. The instant invention is intended to be useable with wires of varying diameters and the plate-recess geometry is not considered as quite so critical. There are other important differences between the invention disclosed in U.S. Pat. No. 3,012,219 and the instant invention. The instant invention utilizes two hermaphroditic mateable housing portions with a terminal plate mounted therein. The instant invention is also constructed so that only one contact between the plate and each conductor is used whereas two are employed with the U-shaped terminal of the other device. The instant invention should also result in a smaller connector for similar applications since the wires may be more closely spaced. This is possible because the terminal plate has wire-receiving portions on opposed edges which allow the terminal plate to be simultaneously moved into the opposed housings to establish connection of the wires. U.S. Pat. No. 3,012,219 does not incorporate these latter features.

SUMMARY OF THE INVENTION

This invention employs two mateable insulating housing units in connection with a terminal plate having wire-receiving portions located on opposed edges. Such a configuration permits the use of hermphroditic housing elements. The housing elements used with this invention may be securely positioned in either of two configurations. In the initial configuration, the housings are not fully mated and wire-receiving portions in the housing are unobstructed. The terminal plate is retained by the two housings elements in the initial configuration, but the terminal plate does not block the wire-receiving passages. In the fully mated configuration, the housing elements are flush providing a fully insulated connector with wires extending therefrom. The housing elements have been moved together so that the terminal plate has established electrical contact with each of the separate conductors.

The terminal plate has means for piercing or displacing the insulation and establishing electrical contact with the conductive core of the wire. Each wire is permanently restrained by the contact established by the plate. Parallel edge slots or lances are two specific structures which may be used for establishing such contact. The terminal plate is located transverse to wires extending substantially perpendicular to one or more sides of the assembled housing.

The primary object of this invention is the provision of a connector for commoning a number of insulated electrical conductors. In addition, the use of simple hermaphroditic connector housings is envisioned in order to lower the cost of producing the connector. Another object is to provide a connector for either splicing two wires or establishing a tap with only slight modifications in the connector housing. The third object is to provide a connector configured so that the terminal may be restrained in two partially mated housings prior to wire installation. Another object is to provide a connector which may be assembled without the need of special tooling. Also, a connector utilizing an insulation piercing terminal eliminating the need for pre-stripping the wire insulation is envisioned. Finally, a connector capable of receiving a relatively large number of wires within a given span is desired.

BRIEF DESCRIPTION OF THE DRAWING

FIG. 3 is an exploded view of the hermaphroditic connector housings and the contact terminal plate.

FIG. 5 is a sectional view showing the wires after contact has been established by the terminal slots.

FIG. 6 shows an alternate embodiment of the connector which might be of particular use in forming a tap connection.

FIG. 7 is a sectional view showing the through wire and the tap connection.

FIG. 8 is an exploded view of second alternative embodiment employing non-planar terminal plate.

DETAILED DESCRIPTION OF THE DRAWING

Figure 1:
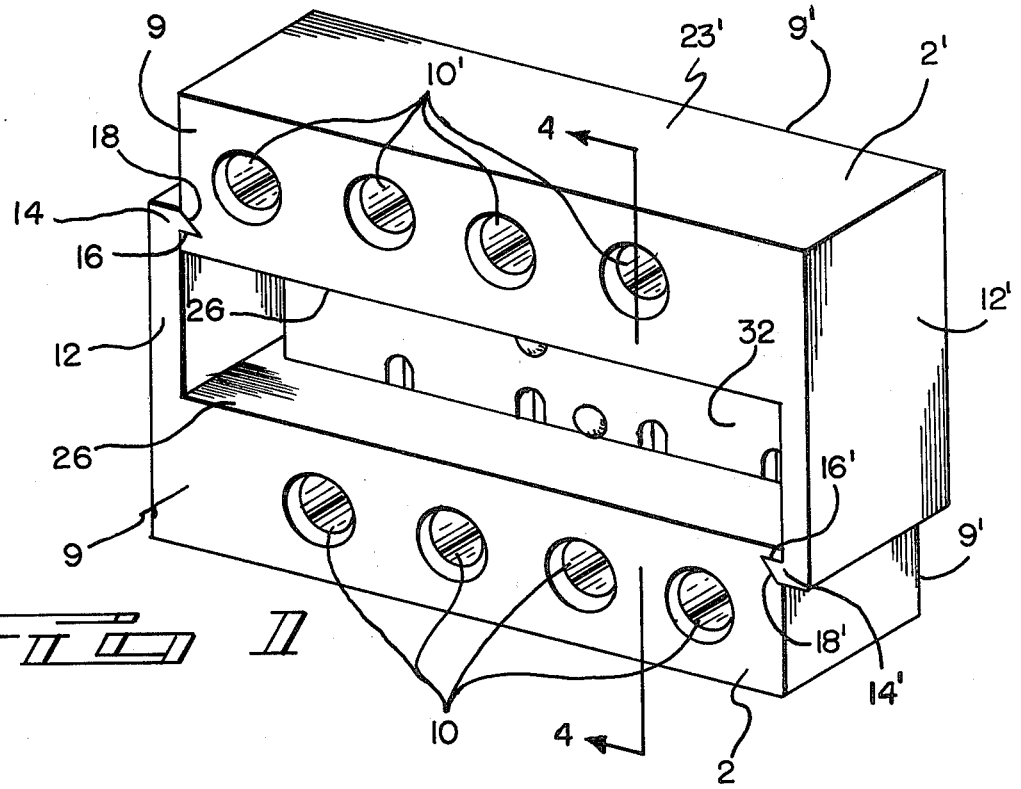
FIG. 1 shows the preferred embodiment of the connector in the initial configuration prior to the installation of the conductors.

This invention incorporates a number of elements to form the connector assembly envisioned. Two mateable housing blocks are employed and in the preferred embodiment, two hermaphroditic housing blocks are used. A terminal with opposed edge wire receiving or contact portions is employed. Each housing block is constructed to receive a portion of the terminal plate in a longitudinal recess. Wire-supporting means extend from at least one side of the housing and cross that recess. Detent means for holding the housing blocks in two different configurations are also shown as are detent means for positioning the terminal prior to installation of wires.

FIG. 3 shows two hermaphroditic housing blocks 2 and 2' composed of an insulating material such as glass-filled nylon with a thin flat terminal plate 32 located therebetween. Each of the housing blocks 2 and 2' has essentially rectangular base portion with an upstanding arm 12 located on one end. Lower housing block 2 in FIG. 3 exposes most of the details of the housing block.

A central longitudinal plate-receiving recess 28 extends from a point adjacent upstanding arm 12 to the opposite end of housing block 2. In this embodiment the sides 27 of the recess are essentially parallel to the front 9 and rear faces 9' of the housing block. The recess 28 begins on opposed face 26 and extends inwardly to a point 30. This configuration has four wire-receiving passages, 10, extending inwardly from the front face of each housing block. Here these passages take the form of circular tubes. In this embodiment, these passages are spaced apart by an equal distance. Each wire receiving passage extends toward the rearward face 9' in FIG. 3 and crosses the plate receiving recess at a position between opposed face 26 and recess end 30. In this embodiment the wire receiving passages are perpendicular to both the front 9 and rear housing faces 9' and the central longitudinal recess 28. This is best shown in either FIGS. 4 or 5. FIG. 3 shows that the four wire-receiving passages 10 are not symmetrically spaced along the length of housing block 2.

Upstanding arm 12 located on the left of the lower housing 2, has wedge or detent means 14 located on its upper end. Detent means 14 is triangular with a locking surface 16 which is perpendicular to arm 12 and inclined surface 18 which intersects surface 16. The right or opposite end of housing block 2 has a channel or notch 20 extending along the entire width of the housing block. This notch is adjacent to opposed face 26. Notch 20 is triangular with a channel locking surface 22 and an inclined surface 24. Notch 20 is dimensioned so that it may be releasably mated with detent means 14. FIG. 1 shows a first position with the two housing blocks positioned so that detent means 14 is mated with notch 20. Note that opposed surfaces 26 and 26' are spaced apart. Upstanding arm 12 is dimensioned so that the two block 2 and 2' may be forced together so that opposed surfaces 26 and 26' come in contact at which point detent means 14 lock against the exterior face 23' of each block. This requires that the distance between opposed face 26 and locking surface 16 be equal to the height of the rectangular block. This second position is shown in FIG. 2.

The terminal plate 32 shown in FIG. 3 is made of resilient conductive metal such as brass and can be inserted into recesses 28 on each housing block. Terminal 32 is essentially rectangular with slots 34 *a*, *b*, *c*, & *d* and 34 *a'*, *b' c'*, & *d'* extending inwardly from the opposed longitudinal edges of the terminal. These slots act as conductor contact means in this embodiment. Each slot has essentially parallel edges along the major portion of its length. The width of these is less than the diameter of the conductive core of the wire which is to be used. The slots are spaced apart so that they may be aligned with passages 10. Slots 34 are not in line with slots 34' in the embodiment of FIG. 3. These slots 34' are offset towards the left of terminal plate 32. Slots 34 on the lower edge of terminal plate 32 are offset towards the right. The offset for the slots on the terminal plate is equivalent to the offset of the passages 10 in housing blocks 2 and 2'. This offset can be of value in relieving stresses in the terminal plate. Two raised surfaces or dimples 38 extend from the front face of plate 32. These dimples are each spaced from the vertical center line of terminal plate 32 and are on opposite sides thereof. It should be noted that the length of terminal plate 32 is substantially equal to the length of recess 28 so that movement is prevented when the plate is placed in the recess. This is, of course, necessary for proper alignment of the slots with the wire-receiving passages 10.

Figure 2:
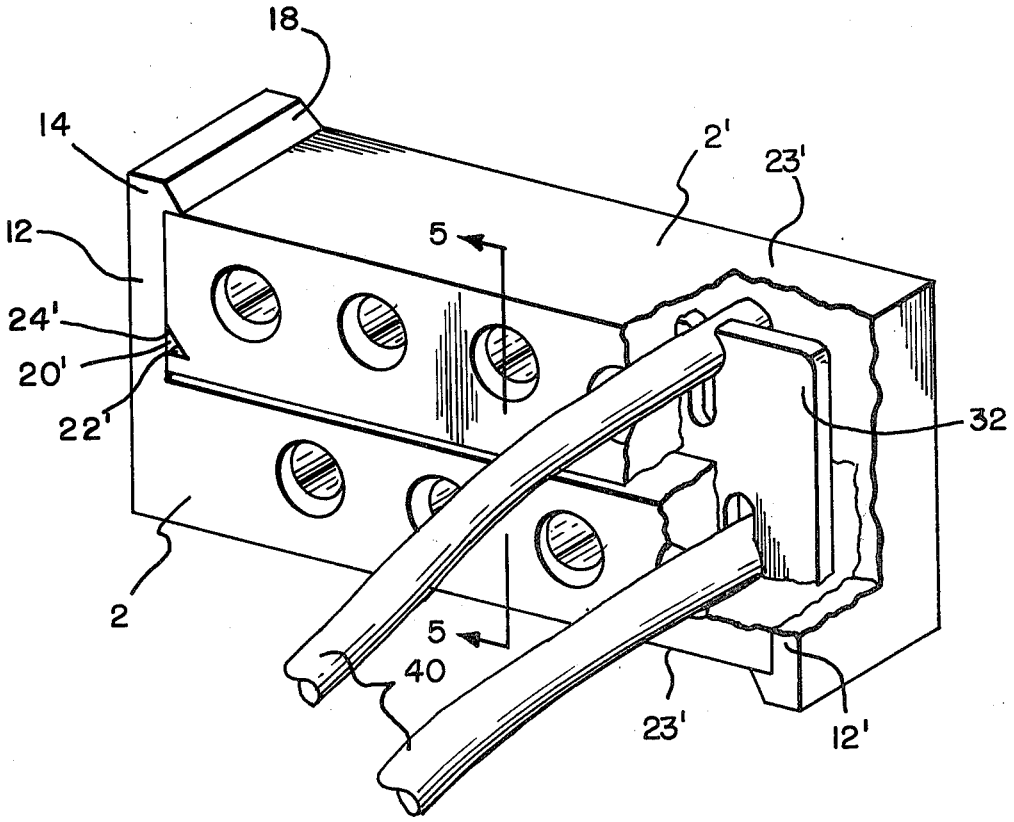
FIG. 2 shows the preferred embodiment of the connector after insertion of the wires into the wire-receiving slots.
Figure 4:
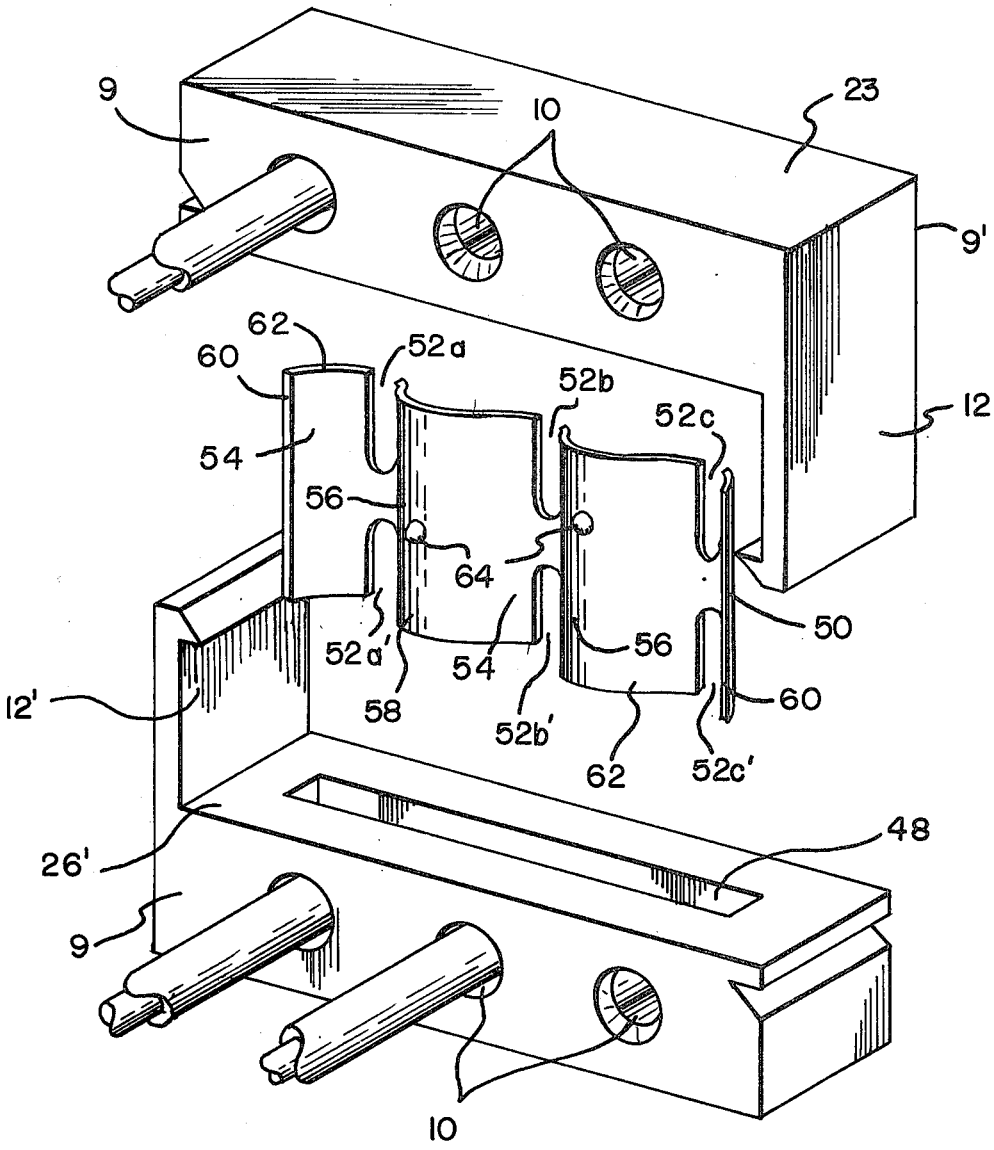
FIG. 4 is a sectional view showing the wires just prior to insertion into the terminal slots.

FIGS. 1 and 2 show the two configurations in which this connector can be placed. FIG. 1 shows the two housing blocks 2 and 2' and terminal plate 32 positioned prior to installation of conductors. Detent means 14 and notches 20 are engaged and opposed surfaces 26 and 26' are spaced apart. Terminal plate 32 is partially positioned in recess 28 in each housing block. Dimples 38 abut opposed surfaces 26 and 26' allowing passages 10 to remain unobstructed. FIG. 4 shows that a conductor 40 may be inserted into a wire passage 10 with the end of the conductor abutting the end of the wire passage 11 and the conductor extending across recess 28. One of the slots 34 can then slice through the insulation and make contact with the wire thus establishing the electrical connection.

FIG. 2 shows the connector after the two housing blocks have been pushed together to form the final connection. Detent means 14 engage exterior faces 23 securing the housing blocks. Opposed faces 26 and 26' are now flush. It can be seen that electrical connection with each conductor is established as the slots 34 penetrate the insulation 44 and establish contact with the underlying conductive core 42. Dimples 38 have a relatively low profile and allow the passage of the terminal plate into recess 28.

FIG. 6 shows an alternate embodiment employing the same principles as the embodiment of FIGS. 1–5. In this and the other alternate embodiments the numbering system used for the preferred embodiments has been retained where possible. The embodiment of FIG. 6 does not employ hermaphroditic housing blocks, however. One housing block has open U-shaped transverse passages 46 allowing each conductor 40' to pass from the front 9 to the rear face 9' of the housing. Such a configuration would be of use in making the connection between through wires 40' and tap wire 40 as shown. In making a tap connection it would be sensible to assume that the ends of the through wire might be already attached to some other electrical component. One end could not then be fed through a circular passage such as 10 in FIG. 3. With the open U-type channels a through wire with attached ends could be laced through the channels. Of course, terminal plate 32 and housing 2 would have to be separated to permit such lacing. It should be noted that this modified housing shown would be mateable with a standard housing 2' such as that shown in the preferred embodiment of FIGS. 1–5. FIG. 7 a section demonstrating that the through wire 40', passes through one of the housing blocks.

FIG. 8 shows still another embodiment of this invention. The principle difference between this configuration and that of FIGS. 1–5 is that terminal plate 50 is non-planar, unlike terminal plate 32. Here terminal plate 50 takes on a generally sinusoidal or corrugated shape with alternate concave surfaces 54 and convex surfaces 56. Slots 52 *a*, *b*, and *c* and 52' *a*, *b*, and *c* are located at the rear of the forwardly facing concave surfaces 54. When a wire 40 is firmly gripped in one of these slots, an additional strain relief, not enjoyed with a planar configuration, is obtained. A tension placed on a conductor in one of these slots will tend to flatten the curvature of each plate. As the curvature is flattened, the edges of each slot bite into the conductive core giving a greater resistance to that tension. Unlike the other configuration, where the plate may fit snugly in the recess, the housing recess 48 must have a greater width than terminal plate 58. Were it not for this increased width, the curved terminal plate could not function in the manner envisioned. Slot 48 in FIG. 8 is dimensioned so that plate 50 is normally in contact with the sides of recess 48 only at the ends of plate 50 and at the intermediate bend lines where the curved plate is tangent to a side of recess 48.

With the corrugated terminal shown in FIG. 8, slots 52 are in line with slots 52'. These slots should be placed at the rear of a concave surface. If placed at some other point the strain relief achieved by this terminal would be less than optimum. The necessary alignment of slots thus results in an inability to achieve the stress relief offered by offset terminals.

Figure 9:
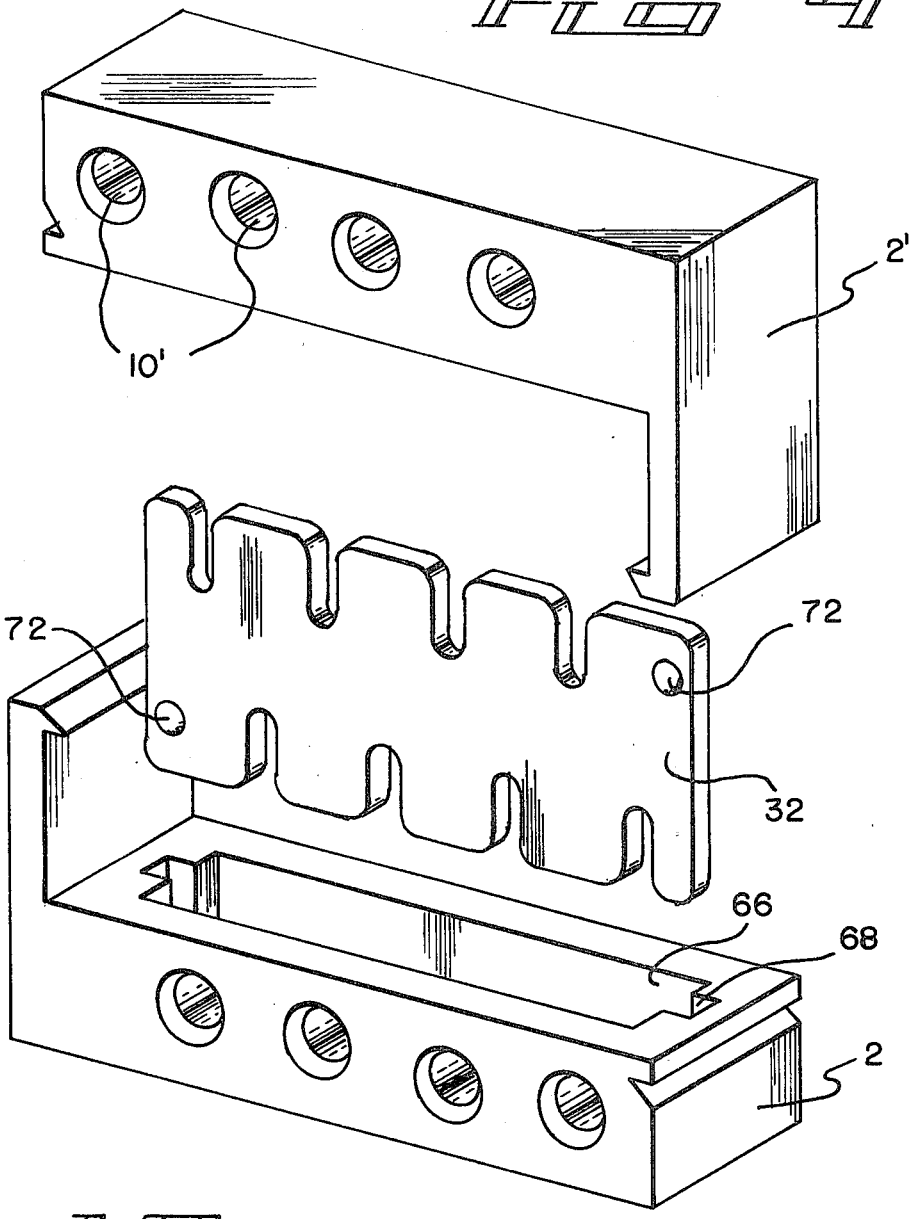
FIG. 9 shows a third alternative embodiment with an enlarged recess.
Figure 10:
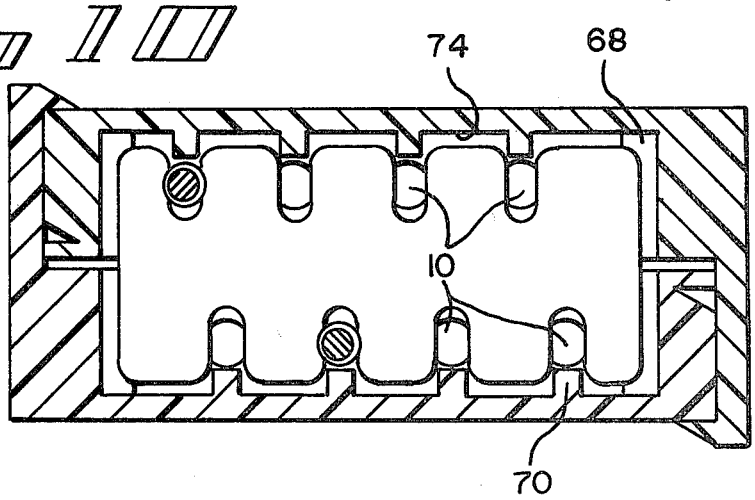
FIG. 10 shows a sectional view of the embodiment of FIG. 9.

FIGS. 9 and 10 show one other embodiment in which the width of the plate receiving recess 66 is greater than the width of the terminal plate 32. Each housing does have a pair of terminal guides 68 located on either end of recess 66. These guides are essentially the same width as plate 32 and serve to locate the plate in the center of recess 66. FIG. 10 shows that this embodiment has platforms 70 which are located in alignment with wire receiving passages 10. These platforms extend across recess 66 and raised above the lower surface 74 of the recess 66. Terminal plate 32 is basically the same as that for the preferred embodiment. The raised surfaces or dimples 72 are located adjacent to the ends of terminal plate 32 so that they may abut terminal guides 68.

Numerous connectors employing the essence of the instant invention but departing from the illustrative embodiments in minor details can be imagined. One example would be a connector which employed insulation piercing lances to impale the conductive core of the conductors rather than slots as used in the illustrative embodiments. Another obvious modification would be the use of multiple terminal plates all adjacent to one side of the housing rather than a single terminal plate. In this way one discrete wire could be connected with another discrete wire without being joined to all of the wires leading into the terminal. That would, of course, require the presence of insulating material between each of the multiple plates. In addition, separate terminal plates or in fact a single multifaced terminal plate could present conductive surfaces adjacent to multiple faces of the housing. That would allow wires to be led into the connector from more than one direction. These and other numerous modifications would not result in a departure from the disclosed invention.

What is claimed is:

1. A two-position electrical connecting device for forming an electrical connection between a plurality of insulated conductors comprising:

a terminal plate of resilient conductive metal, conductor contact means adjacent opposite edges of said terminal plate, two mateable insulating housing blocks, a recess extending inwardly from a corresponding face on each of said housing blocks, and retaining means for holding said housing blocks and said terminal plate in a stationary, open first position and in a stationary, closed second position, in said first position said corresponding faces being spaced apart and in opposition with said recesses in alignment and with said terminal plate partially within each of said recesses and supporting said housing blocks, said housing blocks being movable relatively towards each other into said second position, said retaining means comprising detent means on each housing block for engaging the other housing block and resisting separation of said blocks in said first and in said second positions, and raised surface means on said terminal plate for resisting complete insertion of said terminal plate into said recesses and relative movement of said housing blocks from said first position to said second position, said terminal plate being movable relative to both of said housing blocks during movement from said first position to said second position, whereby wires may be placed in alignment with said contact means and transverse to said terminal plate when said housing blocks are in said open first position, and upon movement to said closed second position, permanent electrical contact is established between said wires and said terminal plate.

2. A connector device as set forth in claim 1 wherein each of said housing blocks has at least one opening for passage of one of said wires extending from one side of said housing block and transversing said recess between the bottom of said recess and the location of one of said edges when said housing blocks and said terminal plate are in said first position so that when said housing blocks are moved into said second position, said conductor contact means establish electrical contact with said conductors.

3. A connecting device as set forth in claim 1 wherein said housing blocks are substantially identical and hermophroditic.

4. A connecting device as set forth in claim 3 wherein said conductor contact means consist of slots extending inwardly from said edges, the width of said slots being less than the width of the electrically conductive core of the conductor with which said slots are to be used.

5. A connecting device as set forth in claim 3 wherein said housing blocks are generally rectangular with an upwardly extending arm located on one end thereof, said detent means being located on said upwardly extending arm.

6. A device as set forth in claim 1 wherein each of said housing blocks has wire supporting means for supporting said wires in a direction transverse to said terminal plate.

7. A device as set forth in claim 6 wherein said wire supporting means comprise platforms extending across said recess in alignment with said contact means.

8. A device as set forth in claim 1 wherein said contact means adjacent opposite edges are offset.

* * * * *